US010697694B2

(12) United States Patent
Steiger et al.

(10) Patent No.: US 10,697,694 B2
(45) Date of Patent: Jun. 30, 2020

(54) CABINET FOR A RECREATIONAL VEHICLE

(71) Applicant: Dometic Sweden AB, Solna (SE)

(72) Inventors: Michael Steiger, Wenden (DE); Torsten Glieden, Siegen (DE); Gerold Heitze, Wilnsdorf (DE); Marcus Remmel, Roth (DE); Magnus Manderbach, Dillenburg (DE)

(73) Assignee: DOMETIC SWEDEN AB, Solna (SE)

( * ) Notice: Subject to any disclaimer, the term of this patent is extended or adjusted under 35 U.S.C. 154(b) by 0 days.

(21) Appl. No.: 16/327,492

(22) PCT Filed: Aug. 23, 2017

(86) PCT No.: PCT/EP2017/071216
§ 371 (c)(1),
(2) Date: Feb. 22, 2019

(87) PCT Pub. No.: WO2018/037038
PCT Pub. Date: Mar. 1, 2018

(65) Prior Publication Data

US 2019/0178564 A1 Jun. 13, 2019

(30) Foreign Application Priority Data

Aug. 23, 2016 (EP) ..... 16185380

(51) Int. Cl.
*F25D 23/02* (2006.01)
*E05D 15/50* (2006.01)
(Continued)

(52) U.S. Cl.
CPC ..... *F25D 23/028* (2013.01); *E05D 7/123* (2013.01); *E05D 11/06* (2013.01); *E05D 15/505* (2013.01);
(Continued)

(58) Field of Classification Search
CPC ..... F25D 23/028; F25D 2323/022; F25D 2323/024; E05D 7/123; E05D 15/505;
(Continued)

(56) References Cited

U.S. PATENT DOCUMENTS 2,166,534 A 7/1939 Rosenfeld
2,541,453 A 2/1951 West
(Continued)

FOREIGN PATENT DOCUMENTS

AU 2010278016 B2 8/2013
AU 2010254762 B2 1/2014
(Continued)

OTHER PUBLICATIONS

European Patent Office, International Search Report and Written Opinion for PCT/EP2017/071216 dated Nov. 10, 2017.
(Continued)

*Primary Examiner* — Daniel J Troy
*Assistant Examiner* — Timothy M Ayres
(74) *Attorney, Agent, or Firm* — Middleton Reutlinger

(57) ABSTRACT

The present invention is directed to a Cabinet for a recreational vehicle having a main housing with an interior space, a front opening, a left side and a right side; and a door configured to seal the front opening. The cabinet further comprises a left hinge mechanism with a left hinge axis and a right hinge mechanism with a right hinge axis to selectively couple the door hinge-wise to the left side or the right side so that the door can either be rotated about the left hinge axis or the right hinge axis. The door comprises a left handle which is operably coupled to the left hinge mechanism and the right hinge mechanism so that operating the left handle allows to rotate the door about the right hinge axis. The door further comprises a right handle which is operable coupled to the left hinge mechanism and the right hinge mechanism
(Continued)

so that operating the right handle allows to rotate the door about the left hinge axis. The left hinge mechanism comprises a left locking member separate from the left hinge axis and the right hinge mechanism comprises a right locking member separate from the right hinge axis; and the left locking member and the right locking member are in engagement with a blocking element. Operating the left handle displaces the blocking element so that the left locking member is disengaged from the blocking element, and operating the right handle displaces the blocking element so that the right locking member is disengaged from the blocking element.

18 Claims, 14 Drawing Sheets

(51) Int. Cl.
*E05D 7/12* (2006.01)
*E05D 11/06* (2006.01)

(52) U.S. Cl.
CPC ... *E05D 2007/128* (2013.01); *E05Y 2201/218* (2013.01); *E05Y 2201/418* (2013.01); *E05Y 2201/474* (2013.01); *E05Y 2800/174* (2013.01); *E05Y 2900/31* (2013.01); *F25D 2323/022* (2013.01); *F25D 2323/024* (2013.01)

(58) Field of Classification Search
CPC ..... E05D 2007/128; E05D 11/06; E05Y 2201/218; E05Y 2201/418; E05Y 2201/474; E05Y 2900/31
USPC ..... 312/405
See application file for complete search history.

(56) References Cited

U.S. PATENT DOCUMENTS 2,624,909 A 1/1953 Khujawa
2,745,132 A * 5/1956 Clark ..... E05D 15/507 16/232
2,790,992 A * 5/1957 Campbell ..... E05D 15/50 16/232
2,885,723 A 5/1959 Altmann
3,174,193 A 3/1965 Smith
3,403,473 A * 10/1968 Navarro ..... E05D 15/502 16/230
3,889,419 A 6/1975 Maleck
4,132,034 A 1/1979 Van Siclen
4,495,673 A * 1/1985 Khan ..... E05D 15/505 16/232
4,503,582 A * 3/1985 Gurubatham ..... E05D 15/505 16/232
4,503,583 A * 3/1985 Frohbieter ..... E05D 15/505 16/232
4,613,174 A * 9/1986 Berg ..... B61D 9/12 105/377.05
4,893,850 A * 1/1990 Mizusawa ..... E05C 3/14 292/128
4,918,271 A 4/1990 Deeg
5,064,255 A * 11/1991 Inui ..... E05D 15/502 312/405
D342,743 S 12/1993 Renner
D342,744 S 12/1993 Renner
5,548,927 A * 8/1996 Song ..... E05D 15/505 49/193
5,675,934 A * 10/1997 Park ..... E05D 15/505 49/193
5,829,197 A * 11/1998 Oh ..... E05D 15/505 49/193
5,966,951 A 10/1999 Hallin et al.
5,966,963 A 10/1999 Kovalaske
6,000,771 A * 12/1999 Wissinger ..... E05D 15/505 312/401
6,401,482 B1 6/2002 Lee et al.
D468,325 S 1/2003 Lorek et al.
D468,326 S 1/2003 Lorek et al.
D468,327 S 1/2003 Lorek et al.
6,543,250 B1 4/2003 Mills et al.
D476,667 S 7/2003 Lorek et al.
D495,722 S 9/2004 Barcenas et al.
6,802,155 B1 * 10/2004 Kawabata ..... E05B 17/0025 49/192
6,868,692 B2 3/2005 Choi
D508,502 S 8/2005 Moseley
D540,831 S 4/2007 Kim et al.
7,237,402 B2 7/2007 Hallin et al.
D550,256 S 9/2007 Lei et al.
7,269,968 B2 9/2007 Harder et al.
7,278,569 B2 10/2007 Cohen et al.
D563,998 S 3/2008 Doberstein et al.
D578,505 S 10/2008 Tejima et al.
7,516,515 B2 * 4/2009 Leimkuehler ..... E05D 15/505 16/231
D604,340 S 11/2009 Kim et al.
7,736,179 B2 6/2010 Cook et al.
7,913,355 B2 * 3/2011 Choi ..... E05D 15/505 16/230
8,006,515 B2 8/2011 Hallin et al.
8,020,403 B2 9/2011 Rotter et al.
8,136,367 B2 3/2012 Froelicher et al.
8,146,383 B2 4/2012 Lorek et al.
D662,504 S 6/2012 Lohman
8,256,234 B2 9/2012 Watson et al.
8,281,611 B2 10/2012 Davis et al.
D673,144 S 12/2012 Onoue
8,322,805 B2 12/2012 Kwon et al.
8,375,734 B2 2/2013 Hall et al.
8,388,078 B2 3/2013 Kwon et al.
8,424,985 B2 4/2013 Kwon et al.
8,499,578 B2 8/2013 Ferragut, II et al.
8,506,026 B2 8/2013 Kim et al.
8,544,291 B2 10/2013 Kim et al.
8,544,973 B2 10/2013 Kwon et al.
8,567,885 B2 10/2013 Lee et al.
8,651,330 B2 2/2014 Krause et al.
8,651,331 B2 2/2014 Krause et al.
8,677,778 B2 3/2014 Jeon et al.
D701,888 S 4/2014 Schumaker et al.
8,695,371 B2 4/2014 Boarman et al.
8,701,940 B2 4/2014 Krause et al.
8,820,583 B2 9/2014 Kim
8,827,389 B2 9/2014 Lee et al.
8,875,538 B2 11/2014 Lee et al.
8,893,523 B2 11/2014 Talegaonkar et al.
8,925,344 B2 1/2015 Mitchell et al.
8,944,540 B2 2/2015 Kim et al.
9,021,828 B2 5/2015 Vitan et al.
9,022,494 B2 5/2015 Lehman et al.
9,097,454 B2 8/2015 LeClear et al.
9,115,924 B2 8/2015 Leclear et al.
D738,938 S 9/2015 Yamada et al.
9,127,871 B2 9/2015 Bortoletto et al.
9,170,040 B2 10/2015 An
9,297,573 B2 3/2016 Krause et al.
9,302,897 B2 4/2016 Dherde
9,309,103 B2 4/2016 Ergican et al.
D764,028 S 8/2016 Schoenherr et al.
9,672,998 B2 6/2017 Watanabe
D803,602 S 11/2017 Hightower et al.
D813,189 S 3/2018 Lundgard
D826,291 S 8/2018 Lim et al.
D839,318 S 1/2019 Meda et al.
D849,803 S 5/2019 Meda et al.
2003/0051407 A1 3/2003 Sosa
2004/0000028 A1 * 1/2004 Kim ..... E05D 15/505 16/230
2004/0172881 A1 9/2004 Minami
2005/0200253 A1 * 9/2005 Wissinger ..... F25D 23/028 312/405
2005/0218765 A1 10/2005 Song et al.

(56) References Cited

U.S. PATENT DOCUMENTS

| | | | |
|---|---|---|---|
| 2007/0176527 | A1 | 8/2007 | Sabelhaus et al. |
| 2007/0216272 | A1 | 9/2007 | Park |
| 2007/0295024 | A1 | 12/2007 | Hallin et al. |
| 2008/0047209 | A1 | 2/2008 | Hinterholzer et al. |
| 2008/0048539 | A1 | 2/2008 | Beek et al. |
| 2008/0203739 | A1 | 8/2008 | Lim et al. |
| 2008/0231159 | A1 | 9/2008 | Lee et al. |
| 2009/0095011 | A1 | 4/2009 | Cho |
| 2009/0142458 | A1 | 6/2009 | McCann |
| 2009/0165478 | A1 | 7/2009 | Devos |
| 2010/0126185 | A1 | 5/2010 | Cho et al. |
| 2010/0218925 | A1 | 9/2010 | Candeo |
| 2011/0036693 | A1 | 2/2011 | Lin et al. |
| 2011/0113810 | A1 | 5/2011 | Mitchell et al. |
| 2011/0162403 | A1 | 7/2011 | Selin et al. |
| 2012/0000240 | A1 | 1/2012 | Junge et al. |
| 2012/0023998 | A1 | 2/2012 | Oh et al. |
| 2012/0023999 | A1 | 2/2012 | Oh et al. |
| 2012/0024001 | A1 | 2/2012 | Oh et al. |
| 2012/0102999 | A1 | 5/2012 | Anselmino et al. |
| 2012/0159968 | A1 | 6/2012 | Doucet et al. |
| 2012/0167611 | A1 | 7/2012 | Weirich et al. |
| 2012/0222435 | A1 | 9/2012 | Lopes et al. |
| 2012/0279247 | A1 | 11/2012 | Katu et al. |
| 2012/0324918 | A1 | 12/2012 | Bortoletto et al. |
| 2012/0326587 | A1 | 12/2012 | Jeong et al. |
| 2013/0161165 | A1 | 6/2013 | Han |
| 2014/0049926 | A1 | 2/2014 | Bas et al. |
| 2014/0075844 | A1 | 3/2014 | Walker et al. |
| 2014/0150460 | A1 | 6/2014 | Boarman et al. |
| 2014/0150468 | A1 | 6/2014 | Boarman |
| 2014/0150487 | A1 | 6/2014 | Boarman |
| 2014/0165601 | A1 | 6/2014 | Boarman et al. |
| 2014/0165602 | A1 | 6/2014 | Boarman |
| 2014/0165605 | A1 | 6/2014 | Boarman et al. |
| 2014/0165611 | A1 | 6/2014 | Boarman et al. |
| 2014/0223948 | A1 | 8/2014 | Visin |
| 2014/0260407 | A1 | 9/2014 | Boehringer et al. |
| 2015/0082812 | A1 | 3/2015 | Boarman et al. |
| 2015/0107285 | A1 | 4/2015 | Mitchell et al. |
| 2015/0123534 | A1 | 5/2015 | Kim et al. |
| 2015/0135762 | A1 | 5/2015 | Eveland et al. |
| 2015/0153093 | A1 | 6/2015 | Junge |
| 2015/0225225 | A1 | 8/2015 | Tae et al. |
| 2015/0276305 | A1 | 10/2015 | Hammond et al. |
| 2015/0284237 | A1 | 10/2015 | McMahan et al. |
| 2015/0322694 | A1 | 11/2015 | Carr et al. |
| 2015/0330678 | A1 | 11/2015 | Hu |
| 2015/0330704 | A1 | 11/2015 | Kaymak et al. |
| 2016/0025406 | A1 | 1/2016 | An |
| 2016/0076187 | A1* | 3/2016 | Lee ..... D06F 37/28 312/228 |
| 2016/0076803 | A1 | 3/2016 | Pawar |
| 2018/0018023 | A1 | 1/2018 | Nakamura et al. |
| 2018/0224191 | A1 | 8/2018 | Marolda |
| 2019/0145140 | A1* | 5/2019 | Zhang ..... E05D 3/02 |
| 2019/0178570 | A1 | 6/2019 | Remmel et al. |

FOREIGN PATENT DOCUMENTS

| | | | |
|---|---|---|---|
| AU | 2011248797 | B2 | 10/2014 |
| AU | 2014200864 | B2 | 3/2016 |
| AU | 201710975 | | 3/2017 |
| AU | 201710976 | | 3/2017 |
| AU | 201710992 | | 3/2017 |
| AU | 201710993 | | 3/2017 |
| AU | 201710991 | | 4/2017 |
| AU | 2017317557 | A1 | 2/2019 |
| CA | 2638349 | A1 | 6/2009 |
| CA | 2670339 | A1 | 7/2010 |
| CA | 2706048 | A1 | 12/2010 |
| CA | 2757470 | A1 | 12/2010 |
| CA | 2706067 | A1 | 1/2011 |
| CA | 2755035 | A1 | 4/2012 |
| CN | 86206686 | U | 7/1987 |
| CN | 2084092 | U | 9/1991 |
| CN | 2108881 | U | 7/1992 |
| CN | 2150296 | Y | 12/1993 |
| CN | 2203997 | Y | 7/1995 |
| CN | 2209205 | Y | 10/1995 |
| CN | 2227188 | Y | 5/1996 |
| CN | 2243510 | Y | 12/1996 |
| CN | 2263178 | Y | 9/1997 |
| CN | 2272124 | Y | 1/1998 |
| CN | 1172939 | A | 2/1998 |
| CN | 2307895 | Y | 2/1999 |
| CN | 2315255 | Y | 4/1999 |
| CN | 2414148 | Y | 1/2001 |
| CN | 2429799 | Y | 5/2001 |
| CN | 2496973 | Y | 6/2002 |
| CN | 2498302 | Y | 7/2002 |
| CN | 2521560 | Y | 11/2002 |
| CN | 2558937 | Y | 7/2003 |
| CN | 1465837 | A | 1/2004 |
| CN | 2602131 | Y | 2/2004 |
| CN | 2630763 | Y | 8/2004 |
| CN | 1540127 | A | 10/2004 |
| CN | 2675818 | Y | 2/2005 |
| CN | 1719168 | A | 1/2006 |
| CN | 2867229 | Y | 2/2007 |
| CN | 201144611 | Y | 11/2008 |
| CN | 201152661 | Y | 11/2008 |
| CN | 201165779 | Y | 12/2008 |
| CN | 201173038 | Y | 12/2008 |
| CN | 201386456 | Y | 1/2010 |
| CN | 201434557 | Y | 3/2010 |
| CN | 101787839 | A | 7/2010 |
| CN | 201653044 | U | 11/2010 |
| CN | 201724505 | U | 1/2011 |
| CN | 201756879 | U | 3/2011 |
| CN | 102042733 | A | 5/2011 |
| CN | 202017423 | U | 10/2011 |
| CN | 102251729 | A | 11/2011 |
| CN | 102356289 | A | 2/2012 |
| CN | 102362131 | A | 2/2012 |
| CN | 102362132 | A | 2/2012 |
| CN | 102362134 | A | 2/2012 |
| CN | 202131939 | U | 2/2012 |
| CN | 202361741 | U | 8/2012 |
| CN | 202393147 | U | 8/2012 |
| CN | 202627839 | U | 12/2012 |
| CN | 202673061 | U | 1/2013 |
| CN | 202731625 | U | 2/2013 |
| CN | 202755782 | U | 2/2013 |
| CN | 202788468 | U | 3/2013 |
| CN | 203296635 | U | 11/2013 |
| CN | 103644696 | A | 3/2014 |
| CN | 203605570 | U | 5/2014 |
| CN | 104075531 | A | 10/2014 |
| CN | 203957955 | U | 11/2014 |
| CN | 203957956 | U | 11/2014 |
| CN | 203957958 | U | 11/2014 |
| CN | 203964501 | U | 11/2014 |
| CN | 203964502 | U | 11/2014 |
| CN | 203964503 | U | 11/2014 |
| CN | 203964506 | U | 11/2014 |
| CN | 203964508 | U | 11/2014 |
| CN | 203964522 | U | 11/2014 |
| CN | 203964529 | U | 11/2014 |
| CN | 203964534 | U | 11/2014 |
| CN | 203964546 | U | 11/2014 |
| CN | 203964547 | U | 11/2014 |
| CN | 203980760 | U | 12/2014 |
| CN | 104296467 | A | 1/2015 |
| CN | 204085031 | U | 1/2015 |
| CN | 104328966 | A | 2/2015 |
| CN | 104329880 | A | 2/2015 |
| CN | 104332862 | A | 2/2015 |
| CN | 104343305 | A | 2/2015 |
| CN | 204282888 | U | 4/2015 |
| CN | 204359041 | U | 5/2015 |
| CN | 104677021 | A | 6/2015 |
| CN | 304201123 | S | 7/2017 |

(56) References Cited

FOREIGN PATENT DOCUMENTS

| | | | |
|---|---|---|---|
| CN | 304444504 | S | 1/2018 |
| CN | 109642768 | A | 4/2019 |
| CN | 109642769 | A | 4/2019 |
| DE | 4428051 | A1 | 2/1995 |
| DE | 10307756 | A1 | 9/2004 |
| DE | 102012224167 | A1 | 7/2014 |
| DE | 102016216126 | A1 | 3/2018 |
| EP | 1096088 | B1 | 4/2004 |
| EP | 1329679 | B1 | 1/2007 |
| EP | 1895085 | A2 | 3/2008 |
| EP | 1953483 | A2 | 8/2008 |
| EP | 2426448 | A2 | 3/2012 |
| EP | 2430379 | A2 | 3/2012 |
| EP | 2492621 | A2 | 8/2012 |
| EP | 2562499 | A1 | 2/2013 |
| EP | 2717006 | A1 | 4/2014 |
| EP | 2738486 | A2 | 6/2014 |
| EP | 2765488 | A2 | 8/2014 |
| EP | 2133641 | B1 | 11/2015 |
| EP | 2998670 | A2 | 3/2016 |
| EP | 3287722 | | 2/2018 |
| EP | 2357436 | B1 | 3/2018 |
| EP | 2405216 | B1 | 9/2018 |
| EP | 2927628 | B1 | 9/2018 |
| EP | 2998671 | B1 | 9/2018 |
| EP | 3475635 | A1 | 5/2019 |
| EP | 2908075 | B1 | 6/2019 |
| GB | 191316555 | A | 5/1914 |
| GB | 2107768 | A | 5/1983 |
| GB | 2209794 | B | 7/1991 |
| JP | 52048247 | A | 4/1977 |
| JP | 52048248 | A | 4/1977 |
| JP | 52048250 | A | 4/1977 |
| JP | S5721169 | U | 3/1982 |
| JP | H02154972 | A | 6/1990 |
| JP | 2247479 | A | 10/1990 |
| JP | 2247480 | A | 10/1990 |
| JP | H02275278 | A | 11/1990 |
| JP | H0371087 | U | 7/1991 |
| JP | H03204581 | A | 9/1991 |
| JP | 3271476 | A | 12/1991 |
| JP | H04148180 | A | 5/1992 |
| JP | 4186011 | A | 7/1992 |
| JP | H06201253 | A | 7/1994 |
| JP | 7109864 | A | 4/1995 |
| JP | 7317441 | A | 12/1995 |
| JP | 9264091 | A | 10/1997 |
| JP | 11248339 | A | 9/1999 |
| JP | 11324518 | A | 11/1999 |
| JP | 3161680 | B2 | 4/2001 |
| JP | 4020687 | B2 | 12/2007 |
| KR | 200166856 | Y1 | 2/2000 |
| KR | 2004042748 | A | 5/2004 |
| KR | 2005027875 | A | 3/2005 |
| KR | 100756464 | B1 | 9/2007 |
| KR | 100880487 | B1 | 1/2009 |
| KR | 101005189 | B1 | 1/2011 |
| KR | 2014111723 | A | 9/2014 |
| TR | 199901774 | A2 | 3/2001 |
| TR | 20003328 | A2 | 6/2002 |
| TW | 200835840 | A | 9/2008 |
| WO | 2015078307 | A1 | 6/2015 |
| WO | 2015078311 | A1 | 6/2015 |
| WO | 2015078313 | A1 | 6/2015 |
| WO | 2015078314 | A1 | 6/2015 |
| WO | 2015078315 | A1 | 6/2015 |
| WO | 2015078316 | A1 | 6/2015 |
| WO | 2015078317 | A1 | 6/2015 |
| WO | 2016026741 | A1 | 2/2016 |
| WO | 2018036975 | A1 | 3/2018 |
| WO | 2018037038 | A1 | 3/2018 |

OTHER PUBLICATIONS

European Patent Office, European Search Report and Opinion for EP16185380 dated Feb. 9, 2017.
Dometic Product Catalog, Refrigerators, 2015.
Dometic Product Catalog, Refrigerators, 2016.
AU Patent Application No. 2017316505 filed on Feb. 6, 2019.
EU Design Patent Application No. 003351253-0001 filed on Aug. 24, 2016.
EU Design Patent Application No. 003351253-0002 filed on Aug. 24, 2016.
EU Design Patent Application No. 003351253-0003 filed on Aug. 24, 2016.
EU Design Patent Application No. 003351253-0004 filed on Aug. 24, 2016.
EU Design Patent Application No. 003351253-0005 filed on Aug. 24, 2016.
EU Design Patent Application No. 003351253-0006 filed on Aug. 24, 2016.
EU Design Patent Application No. 003351253-0007 filed on Aug. 24, 2016.
EU Design Patent Application No. 003351253-0008 filed on Aug. 24, 2016.
EU Design Patent Application No. 003351253-0009 filed on Aug. 24, 2016.
EU Design Patent Application No. 003351253-0010 filed on Aug. 24, 2016.
EU Design Patent Application No. 003351253-0011 filed on Aug. 24, 2016.
EU Design Patent Application No. 003351253-0012 filed on Aug. 24, 2016.
EU Design Patent Application No. 003351253-0013 filed on Aug. 24, 2016.
EU Design Patent Application No. 003351253-0014 filed on Aug. 24, 2016.
EU Design Patent Application No. 003351253-0015 filed on Aug. 24, 2016.
EU Design Patent Application No. 003351253-0016 filed on Aug. 24, 2016.
EU Design Patent Application No. 003351444-0001 filed on Aug. 24, 2016.
EU Design Patent Application No. 003351444-0002 filed on Aug. 24, 2016.
EU Design Patent Application No. 003351444-0003 filed on Aug. 24, 2016.
EU Design Patent Application No. 003351444-0004 filed on Aug. 24, 2016.
EU Design Patent Application No. 003351444-0005 filed on Aug. 24, 2016.
EU Design Patent Application No. 003351444-0006 filed on Aug. 24, 2016.
EU Design Patent Application No. 003351444-0007 filed on Aug. 24, 2016.
EU Design Patent Application No. 003351444-0008 filed on Aug. 24, 2016.
EU Design Patent Application No. 003351444-0009 filed on Aug. 24, 2016.
EU Design Patent Application No. 003351444-0010 filed on Aug. 24, 2016.
CN Notice of Grant the Patent Right for Design Application received in 201730050701.0 dated Nov. 17, 2017.
CN First Office Action for Design Application received in 201730050701.0 dated Jul. 7, 2017.
Requirement for Restriction/Election issued in U.S. Appl. No. 29/594,930 dated Jan. 1, 2018.
Notice of Allowance issued in U.S. Appl. No. 29/594,930 dated Sep. 6, 2018.
U.S. Appl. No. 29/641,674 entitled "Control Panel" filed Mar. 23, 2018.
Non-Final Office Action issued in U.S. Appl. No. 29/594,936 dated Oct. 19, 2018.
Notice of Allowance issued in U.S. Appl. No. 29/594,936 dated Jan. 10, 2019.

(56) References Cited

OTHER PUBLICATIONS

CN Notice of Granting Patent Right for Design Application received in 201730050365.X dated Jun. 2, 2017.
European Patent Office, International Search Report and Written Opinion for PCT/EP2017/071052 dated Oct. 13, 2017.
DE Patent Application No. 102019209297.7 filed on Jun. 26, 2019.
DE Patent Application No. 102019207919.9 filed on May 29, 2019.
Intention to Grant dated Jan. 31, 2020 for EP Application No. 16185380.9 filed on Aug. 23, 2016 entitled "Cabinet for a Recreational Vehicle".
Office Action for Germany Patent Application No. 102019207919.9 dated Mar. 4, 2020.
Office Action for Germany Patent Application No. 102019209297.7 dated Mar. 12, 2020.

* cited by examiner

CABINET FOR A RECREATIONAL VEHICLE

The present embodiments relate to a cabinet for a recreational vehicle and in particular to a refrigerator for a recreational vehicle. A recreational vehicle in sense of the invention may be a caravan, a mobile home, a yacht or any other vehicle being equipable with a cabinet. Such cabinets comprise a main housing with an interior space, a front opening, a left side and a right side and a door configured to seal the front opening. The door is hingewise coupled to the main housing so that the door can be opened for accessing the interior space.

Recreational vehicles in general have limited space available for built-in components like cabinets. As such, there is increased need to provide sophisticated solutions which allow the users to access the cabinets. To have the most flexibility, it has been suggested to provide a bidirectional opening mechanism, i.e. a mechanism that allows to open the door selectively from the right side or from the left side.

To provide therefore, known cabinets comprise a left hinge mechanism with a left hinge axis and a right hinge mechanism with a right hinge axis to selectively couple the door hinge-wise to the left side or the right side so that the door can either be rotated about the left hinge axis or the right hinge axis. Therefore, the door comprises a left handle which is operably coupled to the left hinge mechanism and the right hinge mechanism so that operating the left handle allows to rotate the door about the right hinge axis. In similar, the door further comprises a right handle which is operable coupled to the left hinge mechanism and the right hinge mechanism so that operating the right handle allows to rotate the door about the left hinge axis.

Further, there are also solutions known in the prior art which do not have the hinge mechanism coupled to a handle. The cabinets comprise snap shut mechanism which selectively disengage either the right rotational axis or the left rotational axis when the door of the cabinet is opened. For instance, EP 1 953 483 A1 shows a refrigerator which could be opened by merely opening the door from either the right side or the left side without the need to operate a handle.

However, known cabinets are not suitable to be used in a recreational vehicle. The holding forces of the door are not sufficient to safely keep the door shut. Especially the snap shut mechanism may unintentionally open in case a centrifugal force is exerted on the door, e.g. by a full brake application or racy rolling turn. This will lead to the unpleasant situation of items stored within the interior space falling out of the cabinet. Especially concerning refrigerators, this will also lead to an increased temperature in the interior space negatively influencing the perishable esculents stored therein.

Thus, there is the need to provide a cabinet being capable of selectively coupling the door hinge-wise to the left side or the right side, allowing for a convenient and easy opening but at the time preventing unintentional opening of the door. Hence, it is the object of the present invention to provide such a cabinet.

The problem is solved by the cabinet according to claim 1. Optional embodiments are described in the dependent claims.

The left hinge mechanism of the cabinet according to the present embodiments comprise a left locking member separate from the left hinge axis and the right hinge mechanism of the cabinet. According to some embodiments, the cabinet further comprises a right locking member separate from the right hinge axis; and the left locking member and the right locking member are in engagement with a blocking element.

An operation of the left handle displaces the blocking element so that the left locking member is disengaged from the blocking element and an operation of the right handle displaces the blocking element so that the right locking member is disengaged from the blocking element.

The cabinet according to the present embodiments thus has at least two locking members which are separate from the respective hinge axis and which are non-movably secured relative to the main housing. Thus, it is possible to lock the locking members by engaging the same with the blocking element. When the door is shut, both locking members are in engagement with the blocking element in form of a positive fit. In said state, unintentional opening of the door is prevented as even high centrifugal forces will not lead to an opening of the door. In case the user wants to open the door, the respective handle is operated so that the blocking element is displaced and the respective locking member is no longer locked by the blocking element.

In some embodiments, displacement of the blocking element by operating the left handle or the right handle blocks operation of the other one of the left handle or the right handle. Hence, it is impossible to operate both handles subsequently. This greatly prevents faulty operation during door opening of the cabinet.

Optionally, the blocking element is an elongated member having a longitudinal axis extending between the left side and the right side when the door is closed. The blocking element comprises a left portion being displaceable by the left handle and a right portion being displaceable by the right handle, wherein the left portion and the right portion are movable relative to each other along the longitudinal axis. Thus, when the cabinet is mounted conventionally, the elongated member forming the blocking element extends virtually horizontally. As the blocking element comprises two portions which can be displaced separately from each other, the space requirements for the blocking element could be reduced, as not the entire blocking member is displaced. Hence, it becomes also clear that the blocking element can comprise of several members which are movable relative to each other. Thus, the cabinet is more compact in its overall design.

In some embodiments, the blocking element further comprises a locking bar, wherein the left portion, the right portion and the locking bar are movable relative to each other along the longitudinal axis. The locking bar is movably supported at the door between a first position and a second position, wherein the locking bar is movable into the first position by a displacement of the left portion and into the second position by a displacement of the right portion. Accordingly, when the left handle is operated the locking bar is either already in the first position or is moved in that position by the displacement of the left portion. As such, when the right handle is operated, the locking bar is either already in the second position or is moved into that position by the displacement of the right portion.

In this connection, it is desirable that the locking bar has a left end and a right end, wherein only the right end abuts against the right portion in the first position or only the left end abuts against the left portion in the second position, when the door seals the front opening. Further, the left end abuts against the left portion and the right end abuts against the right portion when the left handle or the right handle are operated. Hence, the locking bar is sandwiched between the left portion and the right portion when the door is opened by operating either the left handle or the right handle. Thus, the other one of the handles cannot be operated as the locking bar locks the respective left portion or right portion of the blocking element. This further greatly facilitates a compact design which reliably inhibits the other one of the handles to be operable.

In some embodiments, the door comprises at least one engagement member and the locking bar comprises at least a first engagement structure and a second engagement structure. The engagement member is configured to engage the first engagement structure when the locking bar is in the first position and to engage the second engagement structure when the locking bar is in the second position, so that movement of the locking bar is inhibited. Accordingly, the locking bar is secured in either the first position or the second position so that only one of the two handles can be operated, i.e. the left handle when the locking bar is in the first position or the right handle when the locking bar is in the second position. It is thus excluded that both handles are operated at the same time.

In some embodiments, the engagement member is movably coupled to the door in a direction perpendicular to the locking bar between a release position and a locking position, wherein a spring member biases the engagement member into the locking position. The engagement member abuts against the main housing and is moved into the release position against the force of the spring member when the door seals the front opening so that the locking bar is movable between the first position and the second position. The engagement member engages the first engagement structure or the second engagement structure in the locking position. Hence, the locking member at least partially protrudes from the door into the direction of the main housing when the door is opened. When the door is closed and seals the front opening, the engagement member is moved into the door against the force of the spring member into the release position. In doing so, the engagement member disengages from either the first or second engagement structure and the locking bar can be moved again. When opening the door, the engagement member moves into the locking position by the force of the spring member as it is no longer held in the release position by abutting the main housing. Hence, the engagement member engages the first engagement structure when the locking bar is in the first position (i.e. when the left handle is operated) or the second engagement structure when the locking bar is in the second position (i.e. when the right handle is operated). Thus, the locking bar is securely held in place by a reliable engagement.

In some embodiments, wherein the first engagement structure is a first notch and the second engagement structure is a second notch. The engagement member comprises a ratchet configured to engage the first notch or the second notch. This allows for a simplified but highly reliable mechanism to secure the locking bar in either the first or second position.

In some embodiments, the door comprises two engagement members and the locking bar comprises four engagement structures. This redundancy allows for secure inhibition of movement of the locking bar.

In some embodiments, the left portion is coupled to the door by a left biasing element and the right portion is coupled to the door by a right biasing element, wherein the biasing elements exert a force in a direction away from the other one of the left portion or the right portion. Resetting of the respective portion after being displaced by the respective handle thus occurs automatically. Hence, the handle does not need to be returned to its initial position manually, but rather follows the resetting movement of the respective portion caused by the respective biasing element. Preferably, the biasing elements are compression springs.

In some embodiments, the left portion comprises a left latch having a left cam surface wherein the left locking member is configured to slide along the left cam surface when the door is rotated about the right hinge axis so that the left portion is displaced during a door closing operation. Thus, when the door hinged to right side is to be closed again, the user does not need to operate the handle again, but rather can directly close the door. During closing operation, the left locking member comes into contact with the left cam surface of the left latch. As the left locking member is non-movably coupled to the left hinge mechanism relative to the main housing, it displaces the left latch and hence the left portion when the door is closed further. After being displaced entirely, the left latch again snaps into its initial position bringing the left locking member into engagement with the blocking member again.

In some embodiments, the right portion comprises a right latch having a right cam surface wherein the right locking member is configured to slide along the right cam surface when the door is rotated about the left hinge axis so that the right portion is displaced during a door closing operation. Thus, when the door hinged to left side is to be closed again, the user does not need to operate the handle again, but rather can directly close the door. During closing operation, the right locking member comes into contact with the right cam surface of the right latch. As the right locking member is non-movably coupled to the right hinge mechanism relative to the main housing, it displaces the right latch and hence the right portion when the door is closed further. After being displaced entirely, the right latch again snaps into its initial position bringing the right locking member into engagement with the blocking member again.

In some embodiments, the left hinge mechanism comprises a left slot guide wherein the left locking member is guided in the left slot guide when the door is rotated about the left hinge axis, wherein the left locking member abuts against an end of the left slot guide so that rotation of the door about the left hinge axis is limited. Thus, when the left locking member abuts against the end of the left slot guide the door cannot be opened any further. This greatly inhibits damaging of the door and/or the main body.

In this connection, it is preferably when the left slot guide is partly composed of the blocking element so that displacement of the blocking element allows the left locking member to be separated from the left slot guide. Hence, when the blocking element is displaced by operation of the left handle, the left locking member is capable of being removed from the left slot guide. As such, when the blocking element is not displaced, it is impossible to remove the left locking member from the left slot guide. In particular, it is preferable that the left slot guide is partly composed of the left latch of the blocking element.

In some embodiments, the right hinge mechanism comprises a right slot guide wherein the right locking member is guided in the right slot guide when the door is rotated about the right hinge axis, wherein the right locking member abuts against an end of the right slot guide so that rotation of the door about the right hinge axis is limited. Thus, when the right locking member abuts against the end of the right slot guide the door cannot be opened any further. This greatly inhibits damaging of the door and/or the main body.

In this connection, when the right slot guide is partly composed of the blocking element so that displacement of the blocking element allows the right locking member to be separated from the right slot guide. Hence, when the blocking element is displaced by operation of the right handle, the right locking member is capable of being removed from the right slot guide. As such, when the blocking element is not displaced, it is impossible to remove the right locking member from the right slot guide. In particular, it is preferable that the right slot guide is partly composed of the right latch of the blocking element.

In some embodiments, the left hinge mechanism comprises a left notch, wherein the left hinge axis is in engagement with the left notch when the door is rotatable about the left hinge axis, and wherein the left hinge axis is disengaged from the left notch when the door is rotated about the right hinge axis. Thus, the hinge axis can easily be separated to be movable together with the door or to allow for a rotation about the left hinge axis. In addition, the notch has a guiding function when the door is closed again, as the left hinge axis is guided along the left notch when closing the door. As such, slight variations in the adjustment of the door which occur over time, e.g. by vibrations or the like, can be compensated. As such, the right hinge mechanism comprises a right notch, wherein the right hinge axis is in engagement with the right notch when the door is rotatable about the right hinge axis, and wherein the right hinge axis is disengaged from the right notch when the door is rotated about the left hinge axis. Thus, the identical advantages also apply.

The cabinet may be a refrigerator. Thus, the interior space is the cooling space for storing perishable esculents. The esculents are safely stored in the refrigerator, as unintentional opening of the door, and hence a temperature increase is prevented.

The invention will now be described in more detail with reference to the Figures showing one or more embodiments. In the Figures it is shown schematically:

Figure 3:
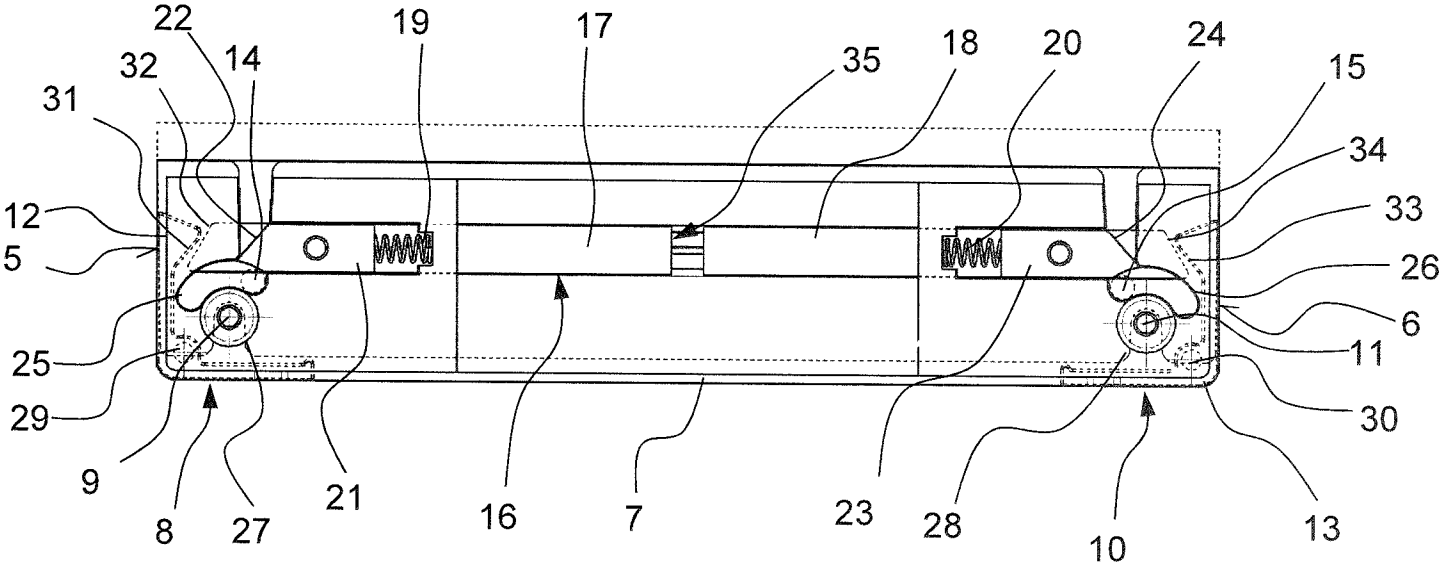
FIG. 3 is a partly cut free top view of the cabinet of the first embodiment with the door closed.
Figure 4:
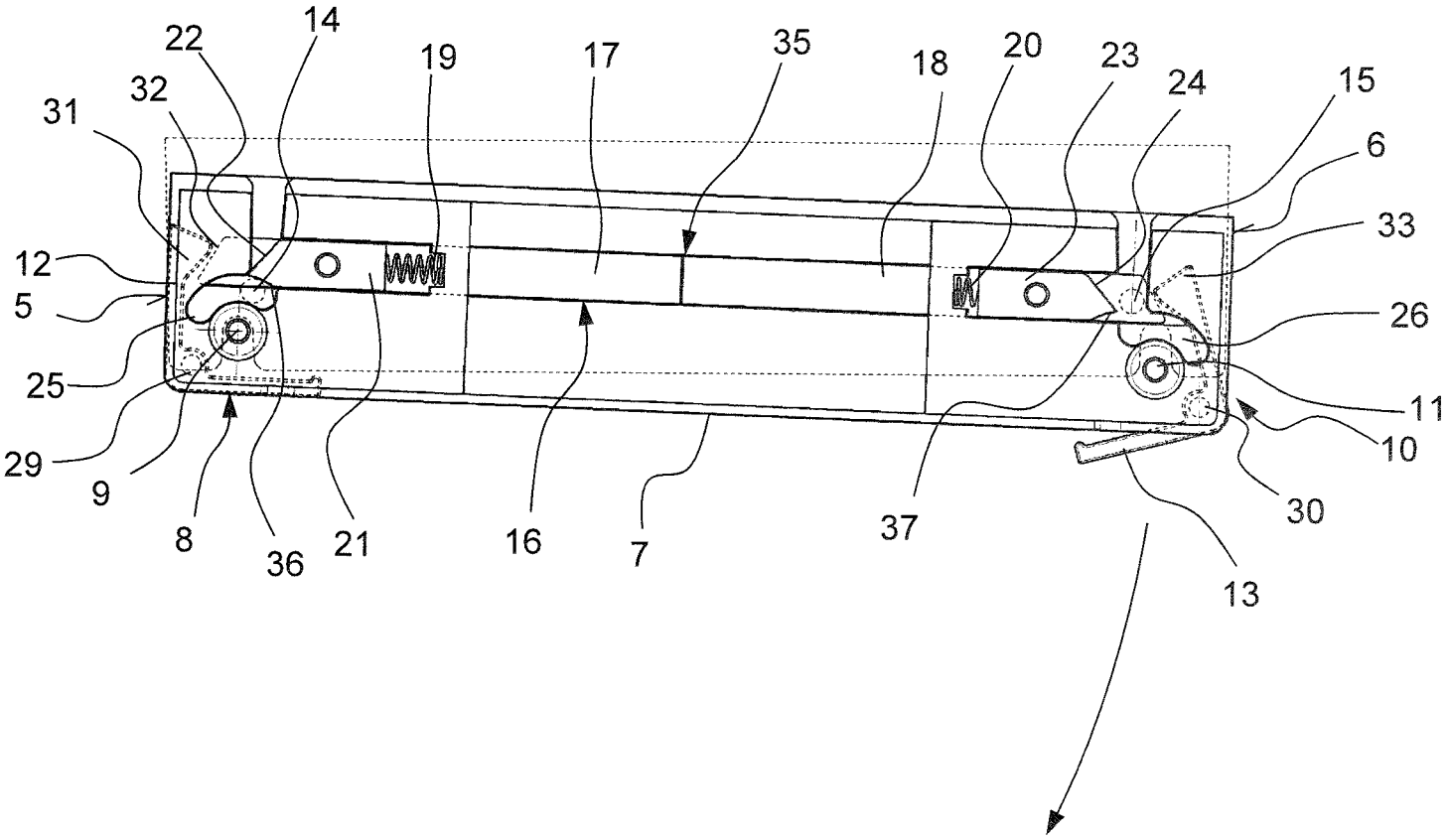
Figure 5:
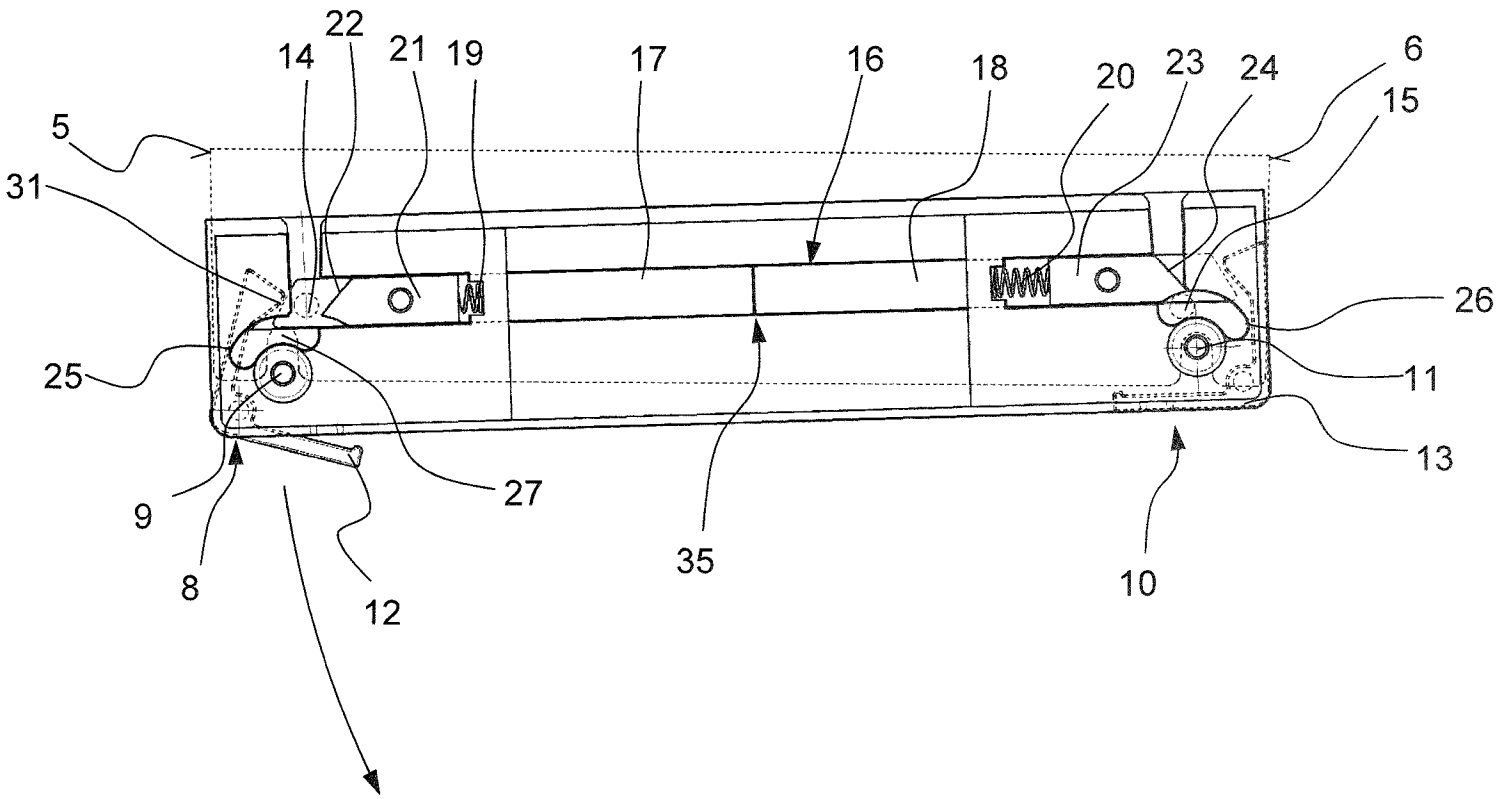
Figure 6:
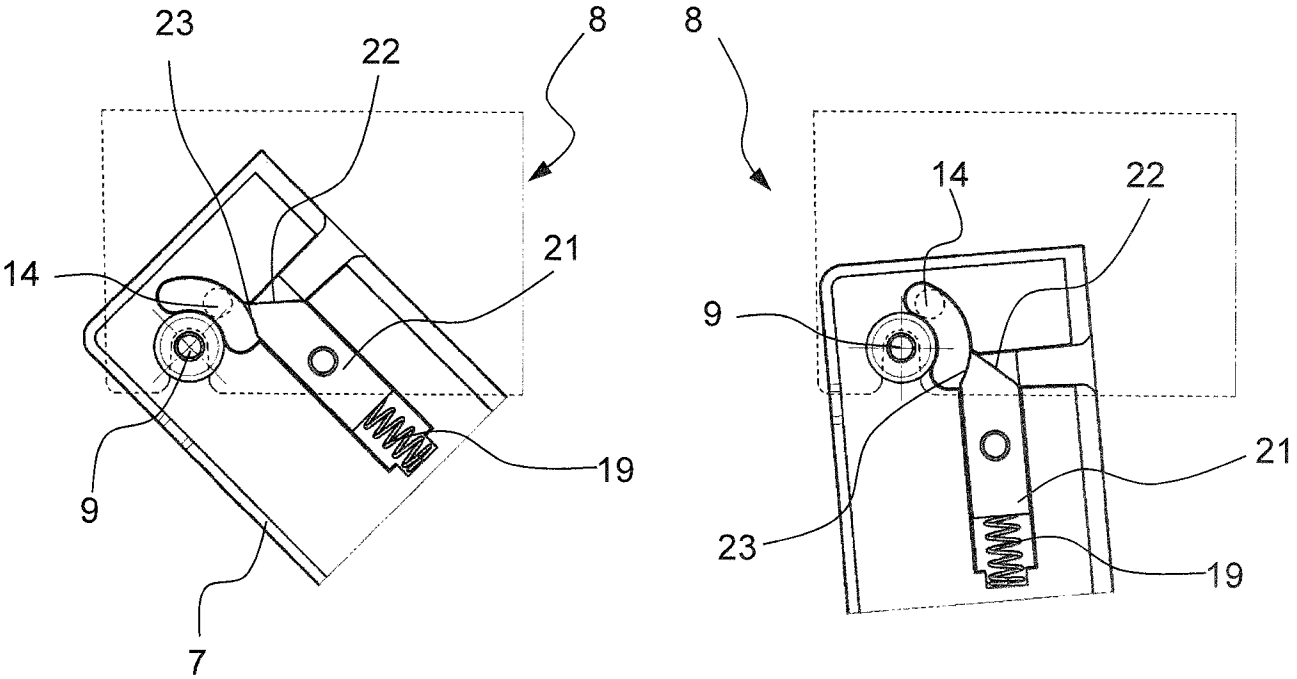
Figure 7:
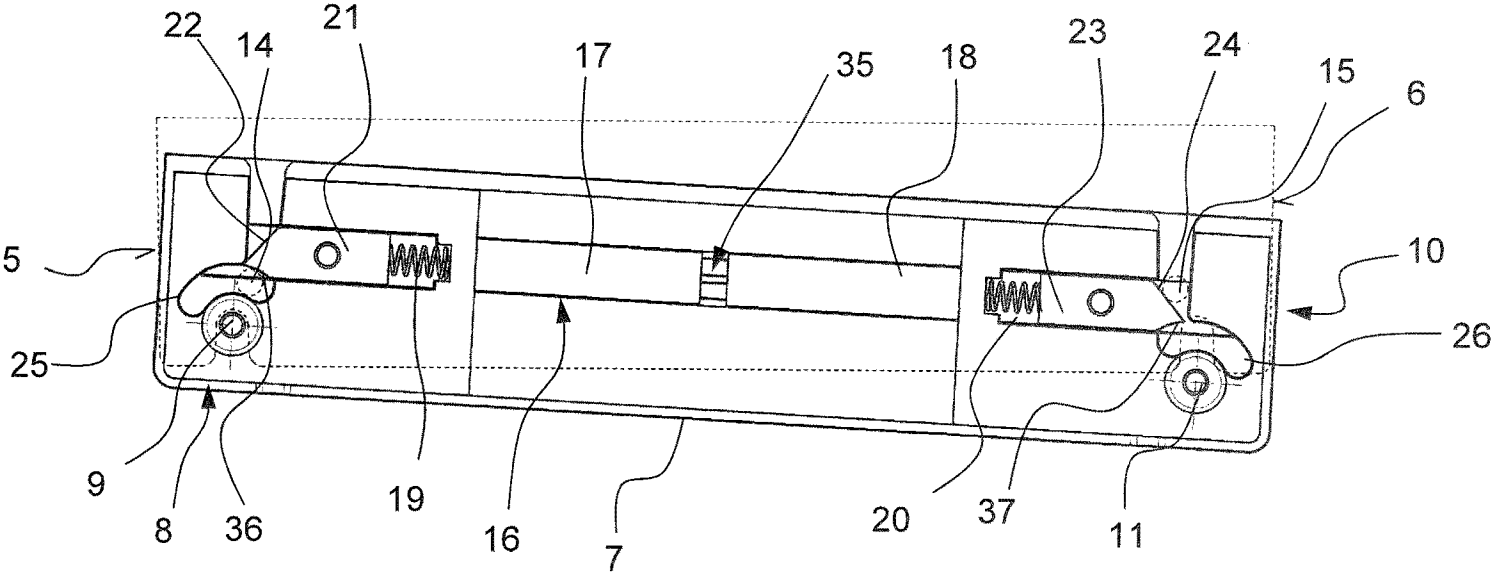
Figure 8:
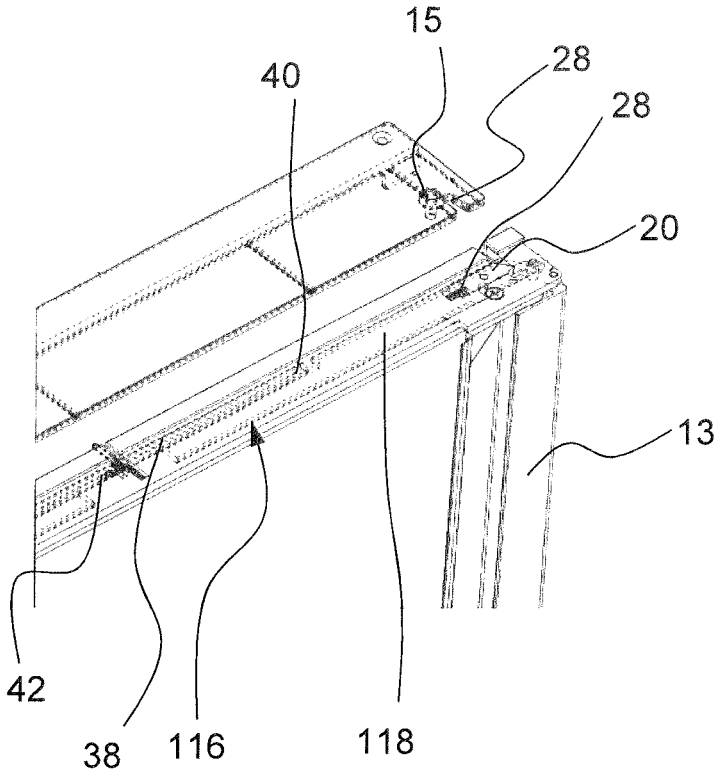
Figure 9:
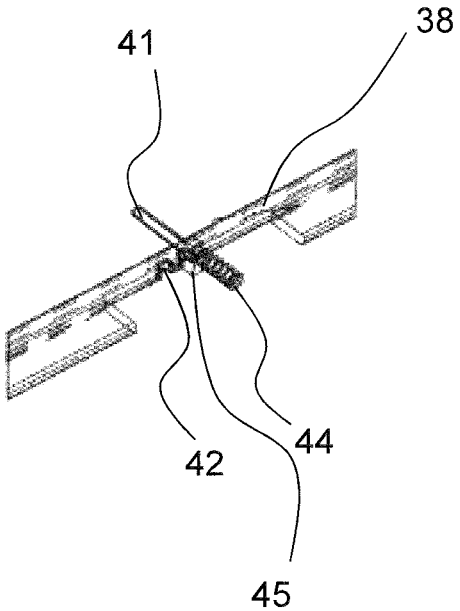
Figure 10:
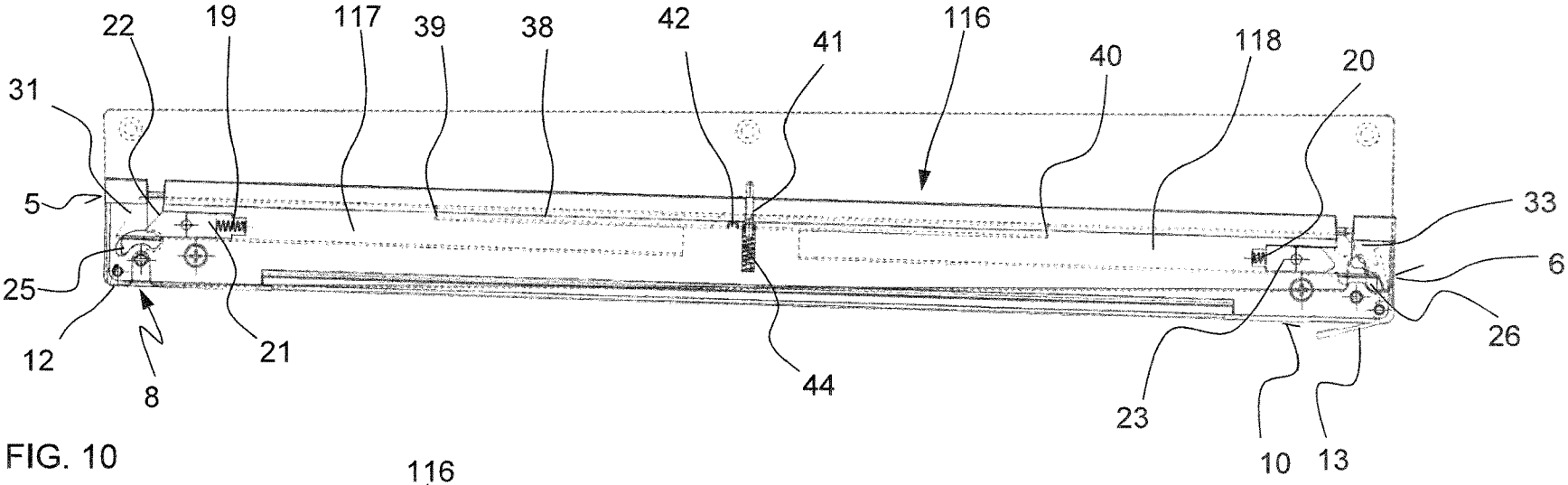
Figure 11:
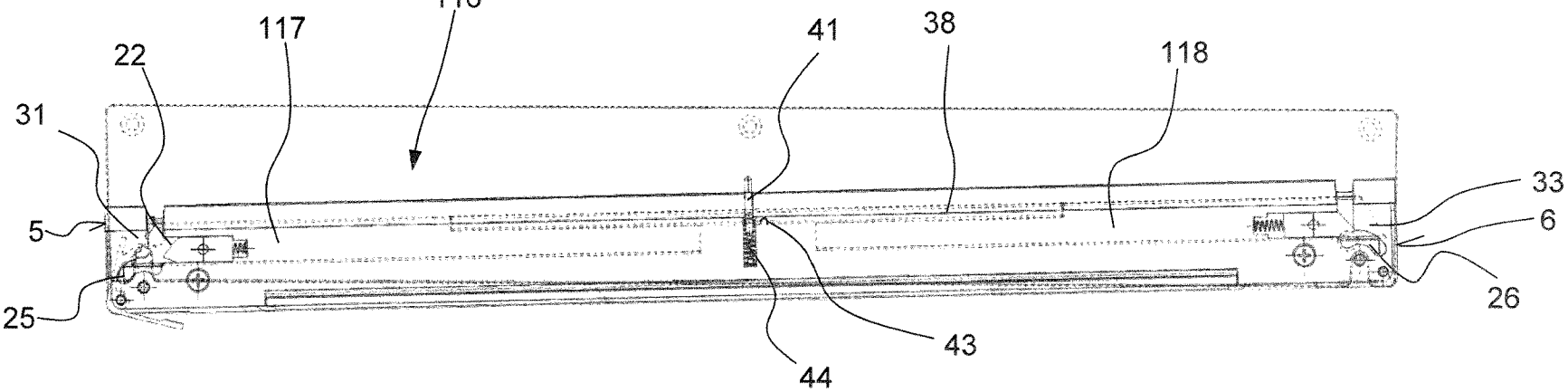
Figure 12:
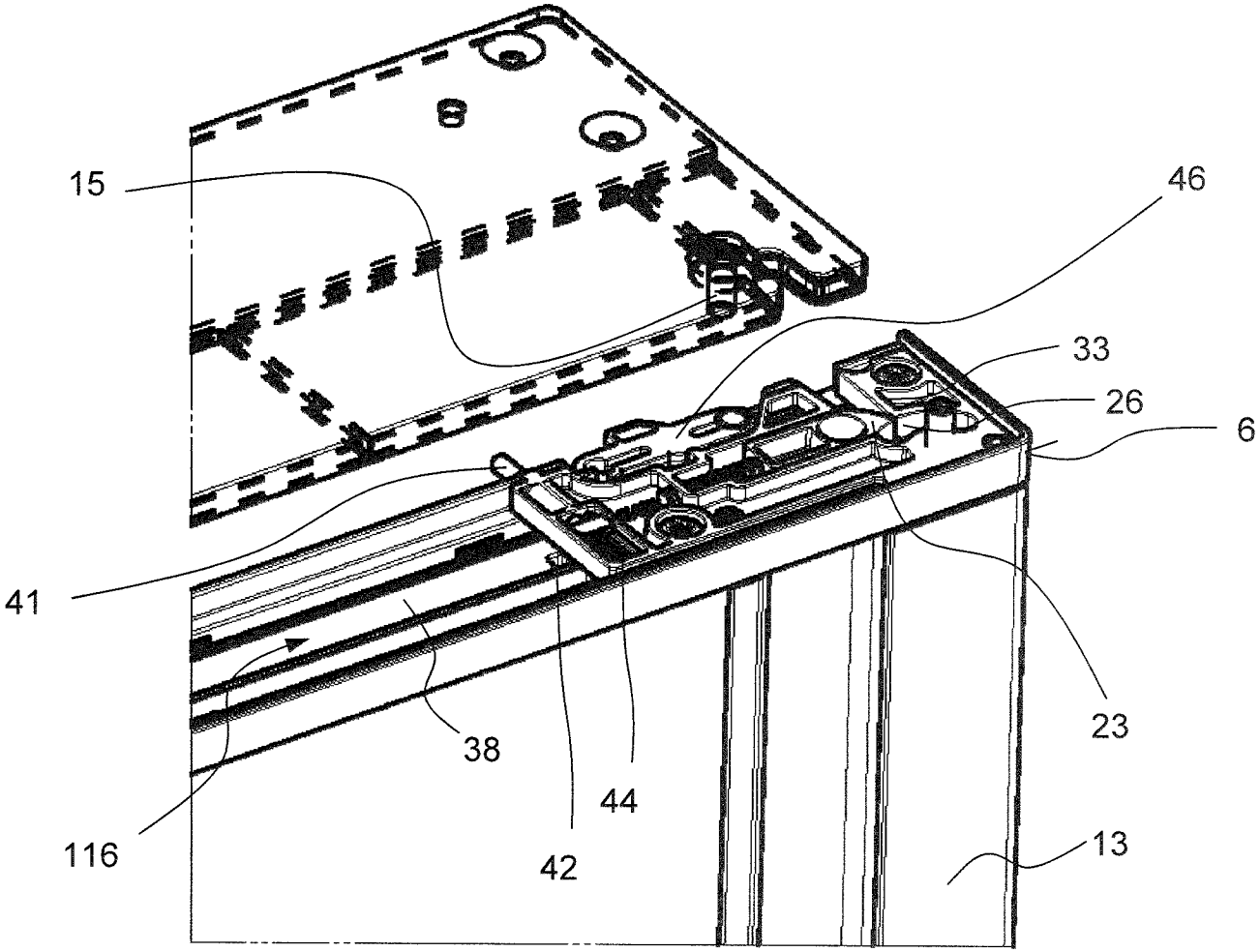
Figure 13:
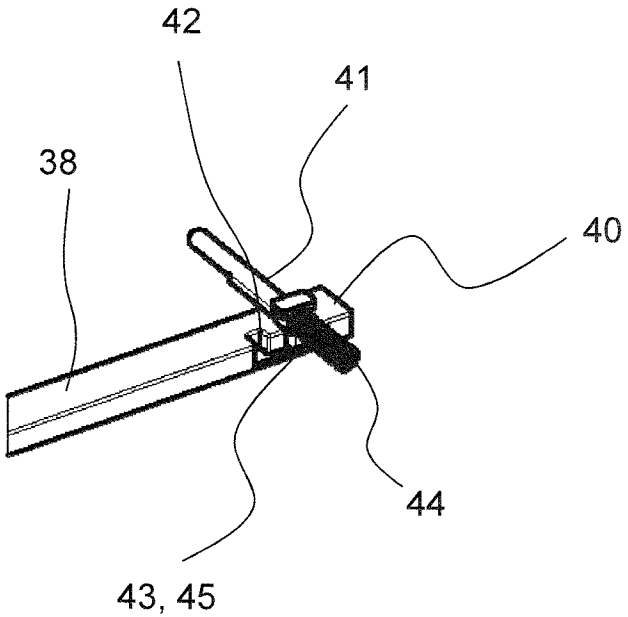
Figure 14:
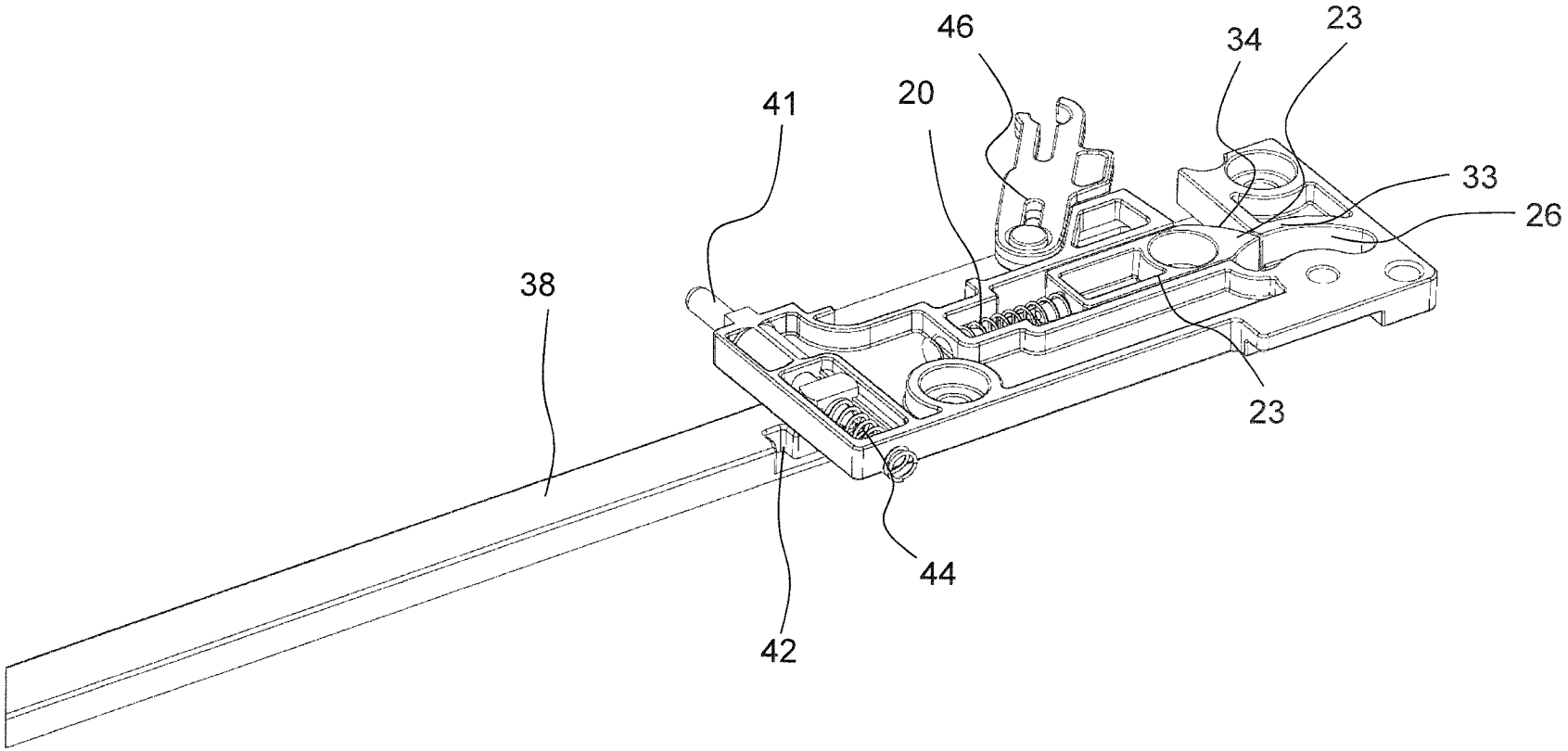
Figure 15:
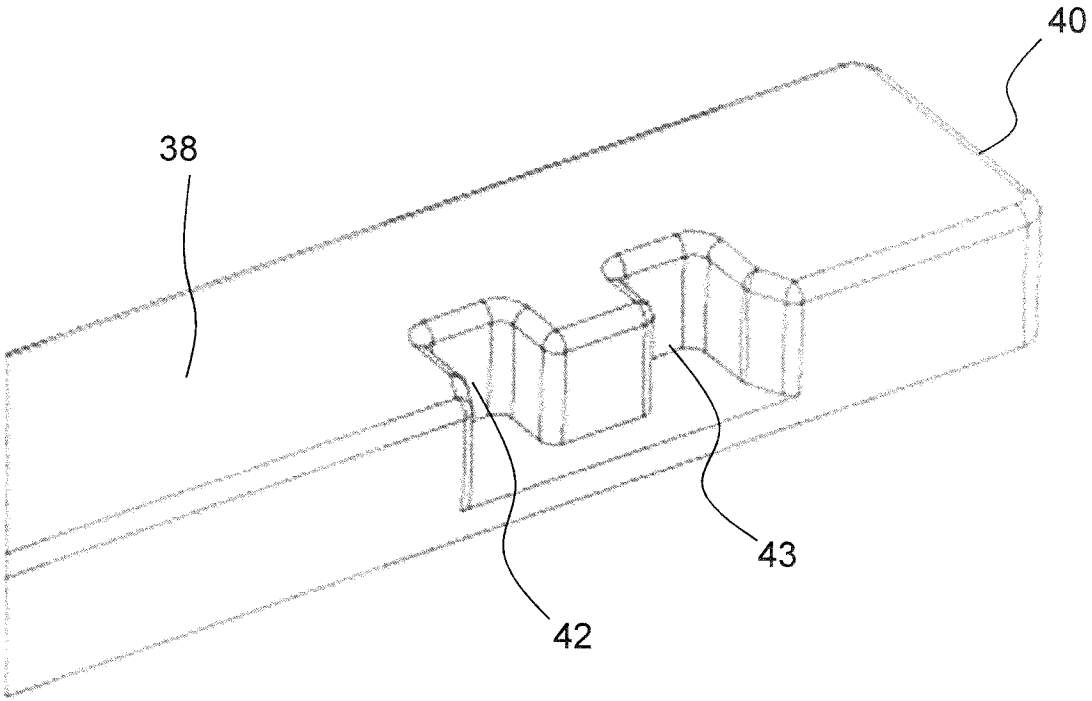

FIG. 4 the view of FIG. 3 with the door being slightly rotated about the left hinge axis;

FIG. 5 the view of FIG. 3 with the door being slight rotated about the right hinge axis;

FIG. 6 a detailed view of the left hinge mechanism;

FIG. 7 the view of FIG. 3 with the door being hinged to left side of the main housing and being in progress of being closed;

FIG. 8 is an exploded view and a detailed view of the right hinge mechanism of a second embodiment;

FIG. 9 is a detailed view of an engagement member and a locking bar;

FIG. 10 is a partly cut free top view of the cabinet of the second embodiment with the door slightly being rotated about the left hinge axis;

FIG. 11 is a partly cut free top view of the cabinet of the second embodiment with the door slightly being rotated about the right hinge axis;

FIG. 12 is an exploded view and a detailed view of the right hinge mechanism of a variant of the second embodiment;

FIG. 13 is a detailed view of the engagement member and the locking bar according to the variant of the second embodiment;

FIG. 14 is a detailed view of a part of the right hinge mechanism of the variant of the second embodiment; and FIG. 15 is a detailed view of the right end of the locking bar of the variant of the second embodiment.

Figure 1A:
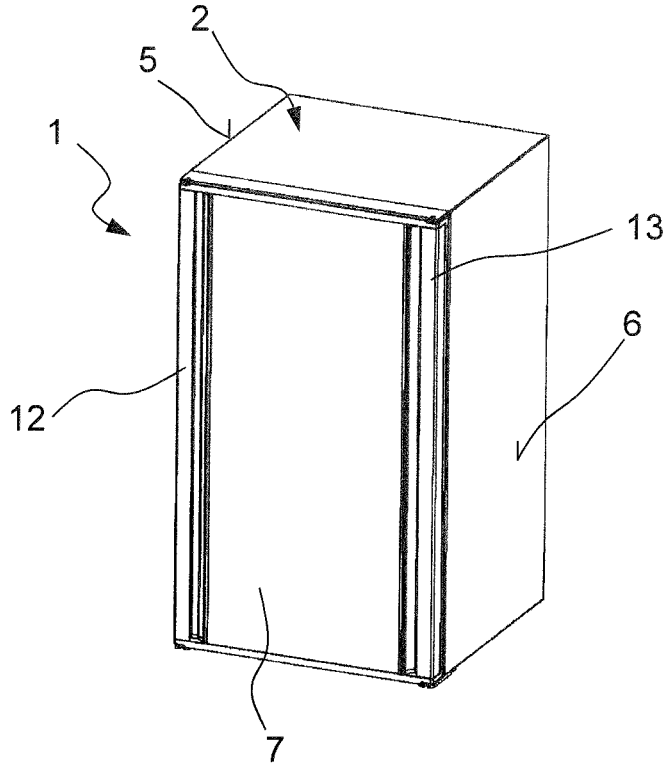
FIG. 1 is a perspective view of the cabinet with the door closed (FIG. 1A), with the door being hinged to the left side of the main housing (FIG. 1B); and with the door being hinged to the right side of the main housing (FIG. 1C)
Figure 1B:
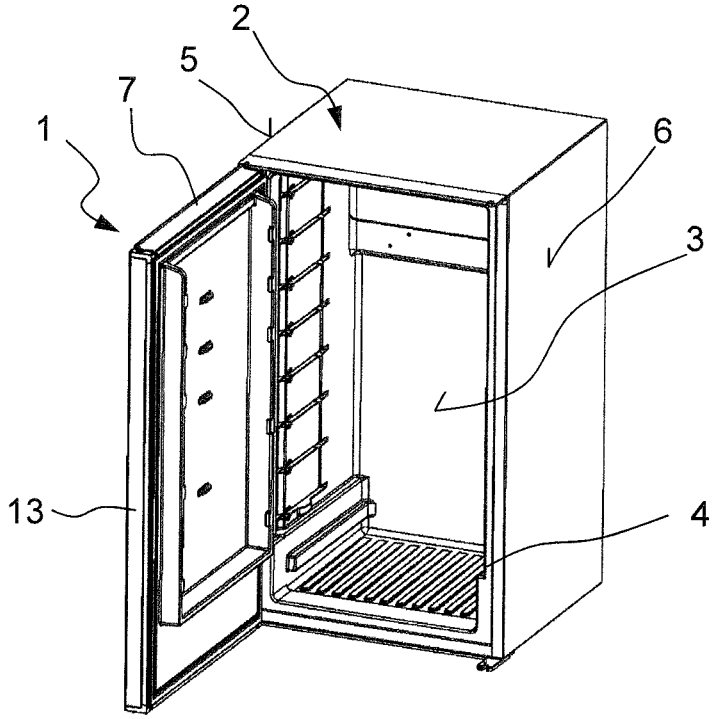
Figure 1C:
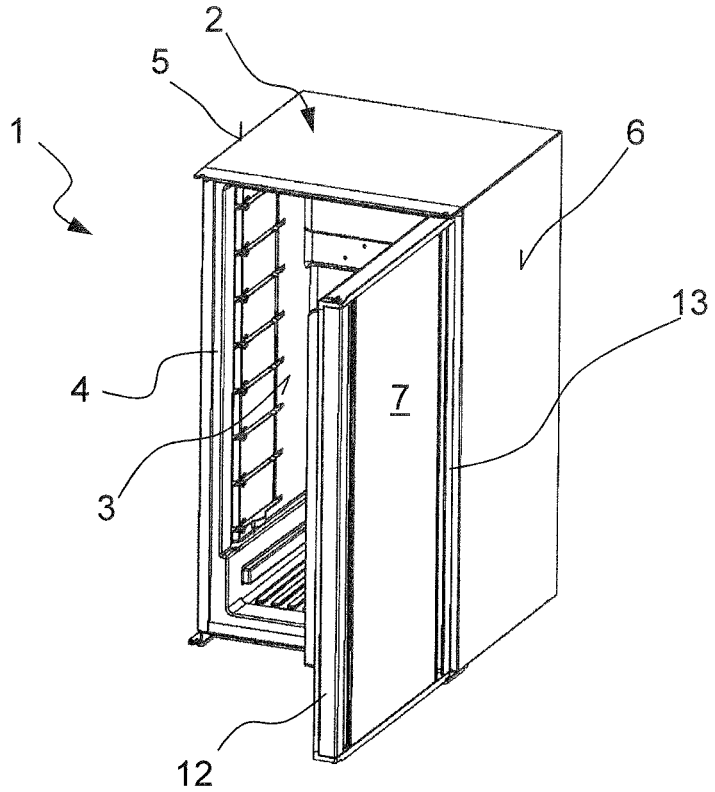
Figure 2:
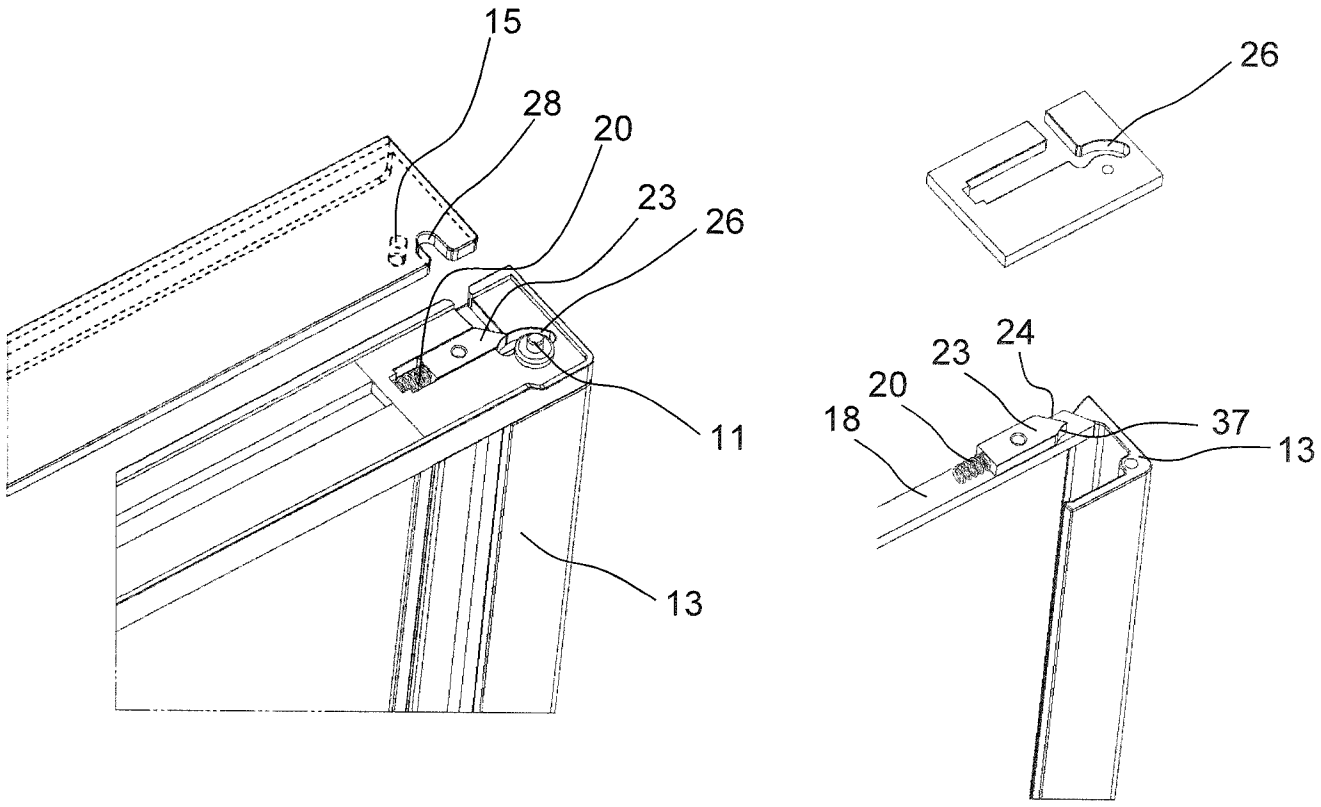
FIG. 2 is an exploded view and a detailed view of the right hinge mechanism of a first embodiment of the present invention.

In FIG. 1 there is shown a cabinet 1 for a recreational vehicle. In this particular embodiment, the cabinet 1 is a refrigerator having a main housing 2, an interior space 3, a front opening 4, a left side 5 and a right side 6. The interior space 3 constitutes a cooling space for storing the items to be cooled, e.g. food, beverages or medicine. The cabinet 1 further comprises a door 7 which seals the front opening 4 when closed. The door 7 could be opened so that a user can access the interior space 3 for placing items into it or taking them out. The cabinet 1 comprises a left hinge mechanism 8 and a right hinge mechanism 9 so that the door 7 can selectively be hinged to the left side 5 or the right side 6 of the main housing 2 as will be explained in more detail below. As such, in FIG. 1B there is shown the cabinet 1 with the door 7 being fully opened and hinged to the left side 5. In contrast, FIG. 1C shows the cabinet 1 with the door 7 being fully opened and hinged to the right side 6.

To open the door 7, there are two handles provided, namely a left handle 12 and a right handle 13. As can be seen e.g. in FIG. 1A, the handles 12, 13 are provided on the lateral outer edges of the door 7 and extend vertically virtually along the entire length of the door 7. The handles 12, 13 are rotatable coupled to door 7 via a left handle hinge axis 29 and a right handle hinge axis 30 (cf. e.g. FIG. 3).

The left hinge mechanism 8 comprises of a left hinge axis 9 about which the door 7 can be rotated when being hinge-wise coupled to the left side 5 of the main housing 2. The left hinge axis 9 is a pin protruding from the top side of the door and extending parallel to the left handle hinge axis 29. The left hinge mechanism 8 further comprises a left locking member 14. The left locking member 14 is a pin protruding from the main housing 2 in a direction towards the door 7. The left locking members 14 extends in parallel to the left hinge axis 9.

The right hinge mechanism 10 comprises of a right hinge axis 11 about which the door 7 can be rotated when being hinge-wise coupled to the right side 6 of the main housing 2. The right hinge axis 11 is a pin protruding from the top side of the door and extending parallel to the right handle hinge axis 30. The right hinge mechanism 10 further comprises a right locking member 15. The right locking member 15 is a pin protruding from the main housing 2 in a direction towards the door 7. The right locking members 15 extends in parallel to the right hinge axis 9.

In addition, the main housing 2 has a left notch 27 and a right notch 28. When the door 7 is closed as shown in FIG. 3, the left hinge axis 9 is engaged within the left notch 27 and the right hinge axis 11 is engaged with the right notch 28. When opening the door 7 either by operating the left handle 12 or the right handle 13, the door is hinge-wise coupled to either the left hinge axis 9 or the right hinge axis 11. The other one of the left hinge axis 9 or the right hinge axis 11 is disengaged from the left notch 27 or the right notch 28 respectively.

The cabinet 1 further comprises a blocking element 16. The blocking element 16 according to the first embodiment shown in FIGS. 3 to 7 is a longitudinal member which extends between the left side 5 and the right side 6 when the door 7 is closed. The blocking element 16 is composed of a left portion 17 and a right portion 18. The left portion has a left latch 21 and the right portion has a right latch 23. The left portion 17 and the right portion 18 are movable to each other along the longitudinal axis of the blocking element 16.

The left portion 17 is displaceable by operating the left handle 12. In particular, when the left handle 12 is rotated about the left handle hinge axis 29 as shown in FIG. 5, a left abutment member 31 of the left handle 12 abuts against a left abutment surface 32 of the left portion 17. When rotating the left handle 12 further, the left abutment member 31 displaces the left portion 17 in a direction away from the left side 5 of the main housing 2.

The right portion 18 is displaceable by operating the right handle 13. In particular, when the right handle 13 is rotated about the right handle hinge axis 30 as shown in FIG. 3, a right abutment member 33 of the right handle 13 abuts against a right abutment surface 34 of the right portion 18. When rotating the right handle 13 further, the right abutment member 33 displaces the right portion 18 in a direction away from the right side 6 of the main housing 2.

The blocking member 16 further comprises a left biasing means 19 coupling the left portion 17 to the door 7 and a right biasing means 20 coupling the right portion 18 to the door 7. As shown e.g. in FIGS. 3 to 5, the left biasing means 19 and the right biasing means 20 are compression springs which bias the left portion 17 and the right portion 18 in a direction away from each other.

As such, when e.g. the left handle 12 is operated so that the left abutment member 31 displaces the left portion 17, the left biasing means 19 is compressed. When releasing the handle 12 again, the left biasing member 19 is decompressed and forces the left portion 17 to its initial position in a direction towards the left side 5 of the main housing 2. Accordingly, when the right handle 13 is operated so that the right abutment member 33 displaces the right portion 18, the right biasing means 20 is compressed. When the handle 13 is released again, the right biasing means 20 is decompressed again and exerts a force pushing the right portion 18 again in its initial position towards the right side 6 of the main housing 2.

In addition, when the biasing means 19, 20 are pushing the left portion 17 or right portion 18 again into the initial position, the respective abutment surface 32, 34 will come into contact with the respective abutment member 31, 33 of the left handle 12 or the right handle 13 and will rotate the respective handle 12, 13 about the respective handle hinge axis 29, 30 so that the handle 12, 13 will in turn also return to its initial position as shown in e.g. FIG. 3.

In addition, as can be seen in e.g. FIG. 4 or FIG. 5, displacement of either the left portion 17 or the right portion 18 will hinder a displacement of the other one of the left portion 17 or the right portion 18 as a movement gap 35 provided between the left portion 17 and the right portion 18 will be closed. Thus, either the left portion 17 or the right portion 18 can be displaced to an amount corresponding to the closure of the movement gap 35. Hence, when e.g. the right handle 13 is fully operated (as shown in FIG. 4), the right portion 18 is displaced to a degree closing the movement gap 35. In this state, the left abutment member 31 can indeed be brought into contact with the left abutment surface 32 by slightly rotating the left handle 12. However, the rotation capability is absolutely minute and the left abutment member 31 cannot displace the left portion 17.

The left hinge mechanism 8 further comprises a left slot guide 25. The left slot guide 25 is partly composed of the left latch 21. In particular, the left latch 21 has a left guide surface 36 which has a curvature corresponding to the left slot guide 25. When the door 7 is closed, the left locking member 14 is guide in the left slot guide 25. When the door 7 is opened via the right handle 13, the door 7 is rotatable about the left hinge axis 9. During the rotational movement of the door 7, the left locking member 14 slides within the left slot guide 25 and finally abuts against an end of the left slot guide 25. In this state, the door 7 cannot be rotated any further about the left hinge axis 9. This is shown in detail in FIG. 6.

The right hinge mechanism 11 further comprises a right slot guide 26. The right slot guide 26 is partly composed of the right latch 23. In particular, the right latch 23 has a right guide surface 37 which has a curvature corresponding to the right slot guide 26. When the door 7 is closed, the right locking member 15 is guide in the right slot guide 26. When the door 7 is opened via the left handle 12, the door 7 is rotatable about the right hinge axis 11. During the rotational movement of the door 7, the right locking member 15 slides within the right slot guide 26 and finally abuts against an end of the right slot guide 26. In this state, the door 7 cannot be rotated any further about the right hinge axis 11.

In addition, the left latch 21 comprises a left cam surface 22 and the right latch 23 comprises a right cam surface 24. The cam surfaces 22, 24 are oblique portions which are provided on that side of the respective latch 21, 23 facing the front opening 4 when being closed. In particular, the cam surfaces 22, 24 slant in a direction towards either the left side 5 (i.e. the left cam surface 22) or the right side 6 (i.e. the right cam surface 24).

Next, an opening operation of the door 7 will be described by operating the right handle 13.

First, the door 7 is closed (cf. FIG. 1 and FIG. 3). In this state, the door 7 cannot be inadvertently opened, as the left locking member 14 and the right locking member 15 are in engagement with the blocking element 16. In particular, the left locking member 14 is disposed in the left slot guide 25 and cannot moved relative to the door 7 as being in engagement with the left latch 21. The right locking member 15 is disposed in the right slot guide 26 and cannot be moved relative to the door 7 as being in engagement with the right latch 23.

Next, the user grabs the right handle 13 and rotates the same about the right handle hinge axis 30. Thereby, the right abutment member 33 is brought into contact with the right abutment surface 34 of the right portion 18 of the blocking element 16. By doing so, the right portion 18 is displaced in a direction away from the right side 6 of the main housing against the force of the right biasing means 20. In addition, the right latch 23 is also displaced as being fixedly secured to the right portion 18. When the right handle 13 is fully operated, the right portion 18 is fully displaced, as is the right latch 23. The right slot guide 26 is thus partly opened, as the right guide surface 37 is displaced. The used now rotates the door 7 about the left hinge axis 9. In doing so, the right hinge axis 11 is disengaged from the right notch 28 and the right locking member 15 is disengaged from the right slot guide 26, cf. FIG. 4. The left locking member 14 is guided in the left slot guide 25 and the door 7 can be opened to a degree until the left locking member 14 abuts against the end of the left slot guide 25.

To close the door 7 again, the user could either hold the right handle 13 in the fully operated position shown in FIG. 4 and close the door 7. The right hinge axis 11 will be guided in the right notch 28 and the right locking member 15 will again enter the right slot guide 26. When the door 7 is closed, the user releases the right handle 13. The right portion 18 of the blocking element 16 will be forced to its initial position by means of the right biasing means 20. Thereby, the right latch 23 is also displaced so that the right slot guide 26 is closed again. The right abutment surfaces 34 abuts against the right abutment member 33 and forces the right handle 13 again in its initial position. In this state, the right locking member 14 is again in engagement with the right portion 18 of the blocking element 16 and the door cannot be inadvertently be opened.

Alternatively, the user could release the handle 13 when the door 7 is open. The right portion 18 will return to its initial position by means of the right biasing means 20. Thereby, also the right handle 13 will return in its initial position as described above. The right latch 23 will close the right slot guide 26, however, the right locking member 15 is not guided in the right slot guide 26 as the door 7 is open. When the door 7 is now closed without operating the right handle 13, the right hinge axis 11 will engage the right notch 28 again and will be guided in the right notch 28. In the same time, the right locking member 15 will contact the right cam surface 24 of the right latch 23 and will slide along the right cam surface 24 as shown in FIG. 7. As the right locking member 15 is fixedly secured to the main housing 2 said movement will force the right latch 23 and the right portion 18 to be displaced against the force of the right biasing means 20. As soon as the right locking member 18 passes the tip of the right latch 23 (i.e. the tip being the border between the right cam surface 24 and the right guide surface 37) the right latch 23 will snap into its initial position thereby engaging the right locking member 15 with the blocking element 16. Thus, the right locking member 15 is guided again in the right slot guide 26 and the door 7 cannot be inadvertently be opened.

Next, a second embodiment of the blocking element 116 will be described with reference to FIGS. 8 to 11, wherein only the differences to the first embodiment will be described. The blocking element 116 according to the second embodiment is an elongated member and comprises of a left portion 117, a right portion 118 and a locking bar 38. The left portion 117 is displaceable by operating the left handle 12 and the right portion 118 is displaceable by operating the right handle 13.

The left portion 117 and the right portion 118 are configured to displace the locking bar 35 between a first position (cf. FIG. 11) and s second position (cf. FIG. 10). Therefore, the locking bar 35 is movably supported at the door 7 in a linear manner, i.e. the locking bar 38 is movable along the longitudinal axis extending from one side 5 to the other side 6 of the door 7.

Operating the left handle 12 causes the left abutment member 31 to abut against the left portion 117 which is displaced along the longitudinal axis against the force of the left biasing means 19. In doing so, the left portion 117 abuts against a left end 39 of the locking bar 38 and moves the locking bar 38 into the first position until a right end 40 of the locking bar 38 abuts against the right portion 118, as shown in FIG. 11. In this state, a further movement of the right portion 118 is inhibited and the right handle 13 cannot be operated. When the door 7 is closed again and the left handle 12 is released, the locking bar 38 remains in the first position, i.e. in a position where the right end 40 abuts the right portion 118.

Thus, in case the left handle 12 is operated again to open the door 7, the left portion 117 is not displacing the locking bar 38, but rather the left portion 117 is displaced until it abuts against the left end 39 of the locking bar 38. As such, in case the right handle 13 is operated when the locking bar 38 is in the first position, the right portion 118 displaces the locking bar 38 into the second position in that it abuts against the right end 40. The locking bar 38 is moved until the left end 39 abuts against the left portion 117, i.e. into the second position.

To hinder a movement of the locking bar 38 from the first position into the second position or vice versa when the doors 7 is open, the door 7 comprises an engagement member 41 which engages a first engagement structure 42 of the locking bar 38 in the first position and a second engagement structure 43 of the locking bar in the second position 43. In particular, the engagement member 41 is a pin like member which is movable coupled to the door 7 in a direction perpendicular to the longitudinal axis. As can be seen in e.g. FIG. 9 the engagement member 41 is urged into a direction away from the door 7 via a spring member 44. In this embodiment, the spring member 44 is a coil spring which biases in the engagement member 41 into a locking position, i.e. into a position where the engagement member 41 protrudes from the door 7. When the door 7 is closed and seals the front opening, the engagement member 41 abuts against the main housing 2 and is forced into a release position against the biasing force of the spring member 44.

For engagement, the first engagement structure 42 is a first notch and the second engagement structure 43 is a second notch, and the engagement member 41 comprises a ratchet 45, cf. FIG. 8 and FIG. 9. The ratchet 45 engages the first notch 42 when the locking bar 38 is in the first position and the engagement member 41 is in the locking position. Accordingly, the ratchet 45 engages the second notch 43 when the locking bar 38 is in the second position and the engagement member 41 is in the locking position. In other words, in case the door 7 is open, the engagement member 41 is always urged into the locking position by the biasing force of the spring member 44. In said locking position the engagement member 41 engages either the first notch 42 or the second notch 43 depending on the position of the locking bar 38. Thus, when the door 7 is open, the locking bar 38 cannot be moved any longer. Thus, even in case the left handle 12 or right handle 13 is released and moves back into the initial position due to the urging force of the left biasing means 19 or right biasing means 20, the locking bar 38 is still hindered from moving as the ratchet 45 of the engagement member 41 is in engagement with either first notch 42 or the second notch 43.

A variant of the second embodiment is shown in FIGS. 12 to 15. Here, the engagement member 41 is not placed about in the middle between left side 5 and the right side 6 of the door 7, but rather is associated with the right hinge mechanism 10. The first notch 42 and the second notch 43 of the locking bar 38 are thus disposed close to the right end 40 of the locking bar 38. As a matter of course, a respective engagement member 41 can alternatively or additionally be associated with the left hinge mechanism 8. In case an additional engagement member 41 is provided with the left hinge mechanism 8, the locking bar 38 will comprise two additional engagement structures which are preferably mirrored compared to the first notch 42 and the second notch 43 as shown in e.g. FIG. 13.

A pivotable arm 46 is attached to the right hinge mechanism 8 as shown in FIGS. 12 and 14. The arm 46 can be rotated so that it can engage the right locking member 15. In case the arm 46 is in engagement with the locking member 15, the door 7 remains open to slight degree. Thus, air circulation is possible when the refrigerator 1 is not in use, as is the case e.g. in winter time. Hence, mold formation in the interior space 3 can be inhibited.

LIST OF REFERENCE SIGNS

1 cabinet/refrigerator
2 main housing

3 interior space
4 front opening
5 left side
6 right side
7 door
8 left hinge mechanism
9 left hinge axis
10 right hinge mechanism
11 right hinge axis
12 left handle
13 right handle
14 left locking member
15 right locking member
16 blocking element
17 left portion
18 right portion
19 left biasing element
20 right biasing element
21 left latch
22 left cam surface
23 right latch
24 right cam surface
25 left slot guide
26 right slot guide
27 left notch
28 right notch
29 left handle hinge axis
30 right handle hinge axis
31 left abutment member
32 left abutment surface
33 right abutment member
34 right abutment surface
35 movement gap
36 left guide surface
37 right guide surface
38 locking bar
39 left end
40 right end
41 engagement member
42 first engagement structure/first notch
43 second engagement structure/second notch
44 spring member
45 ratchet
46 arm
116 blocking element
117 left portion
118 right portion

The invention claimed is:

1. A cabinet for a recreational vehicle having a main housing with an interior space, a front opening, a left side and a right side; and a door configured to seal the front opening;

wherein the cabinet further comprises a left hinge mechanism with a left hinge axis and a right hinge mechanism with a right hinge axis, each of the left hinge mechanism or the right hinge mechanism configured to selectively couple the door to the left side or the right side, respectively so that the door can either be rotated about the left hinge axis or the right hinge axis; and the door comprises a left handle which is operably coupled to the left hinge mechanism and the right hinge mechanism so that a user operating the left handle allows to rotate the door about the right hinge axis; and the door further comprises a right handle which is operable coupled to the left hinge mechanism and the right hinge mechanism so that a user operating the right handle allows to rotate the door about the left hinge axis;

wherein the left hinge mechanism comprises a left locking member separate and spaced apart from the left hinge axis during rotation about the left hinge axis and the right hinge mechanism comprises a right locking member separate and spaced apart from the right hinge axis during rotation about the right hinge axis; and the left locking member and the right locking member are non-movably secured relative to the main housing and in engagement with a blocking element in form of a positive fit;

wherein movement of the left handle relative to the door displaces the blocking element so that the left locking member is disengaged from the blocking element; and wherein movement of the right handle relative to the door displaces the blocking element so that the right locking member is disengaged from the blocking element.

2. The cabinet according to claim 1, wherein displacement of the blocking element by operating the left handle or the right handle blocks operation of the other one of the left handle or the right handle.

3. The cabinet according to claim 1, wherein the blocking element is an elongated member having a longitudinal axis extending between the left side and the right side when the door is closed, the blocking element comprising a left portion being displaceable by the left handle and a right portion being displaceable by the right handle, wherein the left portion and the right portion are movable relative to each other along the longitudinal axis.

4. The cabinet according to claim 3, wherein the blocking element further comprising a locking bar;

wherein the left portion, the right portion and the locking bar are movable relative to each other along the longitudinal axis; and wherein the locking bar is movably supported at the door between a first position and a second position, wherein the locking bar is movable into the first position by a displacement of the left portion and into the second position by a displacement of the right portion.

5. The cabinet according to claim 4, wherein the locking bar has a left end and a right end, wherein only the right end abuts against the right portion in the first position or only the left end abuts against the left portion in the second position, when the door seals the front opening; and wherein the left end abuts against the left portion and the right end abuts against the right portion when the left handle or the right handle are operated.

6. The cabinet according to claim 4, wherein the door comprises at least one engagement member and the locking bar comprises at least a first engagement structure and a second engagement structure, wherein the at least one engagement member is configured to engage the first engagement structure when the locking bar is in the first position and to engage the second engagement structure when the locking bar is in the second position, so that movement of the locking bar is inhibited.

7. The cabinet according to claim 6, wherein the at least one engagement member is movably coupled to the door in a direction perpendicular to the locking bar between a release position and a locking position, wherein a spring member biases at least one the engagement member into the locking position;

wherein the at least one engagement member abuts against the main housing and is moved into the release position against a force of the spring member when the door seals the front opening so that the locking bar is movable between the first position and the second position; and wherein the at least one engagement member engages one of the first engagement structure or the second engagement structure in the locking position.

8. The cabinet according to claim 6, wherein the first engagement structure is a first notch and the second engagement structure is a second notch; and the at least one engagement member comprises a ratchet configured to engage the first notch or the second notch.

9. The cabinet according to claim 3, wherein the left portion is coupled to the door by a left biasing element and the right portion is coupled to the door by a right biasing element, wherein the biasing elements exert a force in a direction away from the other one of the left portion or the right portion.

10. The cabinet according to claim 3, wherein the left portion comprises a left latch having a left cam surface wherein the left locking member is configured to slide along the left cam surface when the door is rotated about the right hinge axis so that the left portion is displaced during a door closing operation.

11. The cabinet according to claim 3, wherein the right portion comprises a right latch having a right cam surface wherein the right locking member is configured to slide along the right cam surface when the door is rotated about the left hinge axis so that the right portion is displaced during a door closing operation.

12. The cabinet according to claim 1, wherein the left hinge mechanism comprises a left slot guide wherein the left locking member is guided in the left slot guide when the door is rotated about the left hinge axis, wherein the left locking member abuts against an end of the left slot guide so that rotation of the door about the left hinge axis is limited.

13. The cabinet according to claim 12, wherein the left slot guide is partly composed of the blocking element so that displacement of the blocking element allows the left locking member to be separated from the left slot guide.

14. The cabinet according to claim 1, wherein the right hinge mechanism comprises a right slot guide wherein the right locking member is guided in the right slot guide when the door is rotated about the right hinge axis, wherein the right locking member abuts against an end of the right slot guide so that rotation of the door about the right hinge axis is limited.

15. The cabinet according to claim 14, wherein the right slot guide is partly composed of the blocking element so that displacement of the blocking element allows the right locking member to be separated from the right slot guide.

16. The cabinet according to claim 1, wherein the left hinge mechanism comprises a left notch, wherein the left hinge axis is in engagement with the left notch when the door is rotatable about the left hinge axis, and wherein the left hinge axis is disengaged from the left notch when the door is rotated about the right hinge axis.

17. The cabinet according to claim 1, wherein the right hinge mechanism comprises a right notch, wherein the right hinge axis is in engagement with the right notch when the door is rotatable about the right hinge axis, and wherein the right hinge axis is disengaged from the right notch when the door is rotated about the left hinge axis.

18. The cabinet according to claim 1, wherein the cabinet is a refrigerator.

* * * * *